US007137582B1

(12) United States Patent
Mikkelsen et al.

(10) Patent No.: US 7,137,582 B1
(45) Date of Patent: Nov. 21, 2006

(54) DEVICE BY ICE STORAGE FOR THE DISCHARGING OF ICE

(76) Inventors: Odd-Harry Mikkelsen, Utsikten 3, Stavanger (NO) N-4026; Thor Nerhus, Ølve (NO) N-5637

( * ) Notice: Subject to any disclaimer, the term of this patent is extended or adjusted under 35 U.S.C. 154(b) by 0 days.

(21) Appl. No.: 09/959,789

(22) PCT Filed: Apr. 11, 2000

(86) PCT No.: PCT/NO00/00115

§ 371 (c)(1),
(2), (4) Date: Dec. 12, 2001

(87) PCT Pub. No.: WO00/68623

PCT Pub. Date: Nov. 16, 2000

(30) Foreign Application Priority Data

May 7, 1999 (NO) ..... 19992220

(51) Int. Cl.
*B02C 19/12* (2006.01)

(52) U.S. Cl. ..... 241/235; 241/236; 241/DIG. 27

(58) Field of Classification Search ..... 241/DIG. 27, 241/235, 65, 236, 100, 223, 277, 280, 222
See application file for complete search history.

(56) References Cited

U.S. PATENT DOCUMENTS 2,524,815 A * 10/1950 Leeson ..... 62/73
4,008,740 A * 2/1977 Chermack ..... 141/100
4,333,612 A * 6/1982 Hayashi ..... 241/33
4,632,280 A 12/1986 Mawby et al.
4,788,830 A 12/1988 Schreiner et al.

FOREIGN PATENT DOCUMENTS

| | | |
|---|---|---|
| DE | 2454348 | 5/1975 |
| DE | 3743118 | 4/1999 |
| WO | WO 9729330 | 8/1997 |

* cited by examiner

*Primary Examiner*—Mark Rosenbaum
(74) *Attorney, Agent, or Firm*—James Creighton Wray

(57) ABSTRACT

In an ice storage (10, 12, 14, 16) the aim is to ensure that ice is chipped off that surface of the ice mass in the storage, which stems from the water which froze to ice first. Likewise, efficient discharging of chipped-off ice to external conveyor devices (23) is ensured. This is achieved by means of a particular ice storage floor construction (16) consisting of parallel, elongate, tubular elements (18) placed with intermediate slots. The floor elements (18) carry carriers (20) in the form of strip-like ice-chipping elements, and the tubular floor elements (18) are supported individually rotational and are preferably driven collectively. The ice-chipping elements may alternatively be formed through the cornered cross-sectional shape of the floor elements, which provide distinct, longitudinal edge portions of good chipping and carrying properties.

12 Claims, 9 Drawing Sheets

DEVICE BY ICE STORAGE FOR THE DISCHARGING OF ICE

BACKGROUND OF THE INVENTION

This invention relates to a device by an ice storage or other room for producing and storing ice, in which the ice is scraped loose and let out for further transportation by means of a conveyor.

In known ice storages it is common to loosen pieces of ice from the mass of ice (often in the shape of cubes or crushed plate-ice) by scraping ice loose by hand by means of a spade or a motorized rake mechanism passed across the top of the ice mass. Detached, comminuted scraped-off pieces of ice land in an underlying conveyor in the form of an auger, a conveyor belt or other transport device.

Ice of this kind is used extensively in the fish industry, where fish is cooled and maintains its quality when shipped over short and long distances. The concrete industry represents another large field of application, where it is often desired to cool sand before cementing.

The top of the ice mass in an ice storage, in the form of the upper ice layer, represents ice which stems from the water which was last cooled and transformed to ice. Thus, the advantageous principle "first in, first out" cannot be followed, and with time ice of the lower layers will become old and of deteriorated quality. This is of particular importance in the fish industry, where, reasonably, "fresh ice" is desired as cover for fish.

Known plants are relatively expensive to buy, maintain and run. Operation is relatively complicated and requires a specially trained engineer/operator. Some times, when detached ice is discharged, so much ice will slide down that the conveyor at floor level may become blocked. Known plants are less suitable for smaller ice storages with capacities of about 50 tons.

Other plants are known, which comprise ice storages with one auger, several such augers or chain drive at the bottom. The first type is expensive in production, is restricted as to size and cannot be used in connection with all normal types of ice. The most important drawback is, however, the liability of the construction to require additional cooling. With several augers at the bottom of the ice storage, they are placed one beside the other. Such a known plant has an ice production capacity of about 10–20 tons of ice in one day. This known plant has low ice storage capacity, and does not allow intermediate storage of produced ice to any great extent. By such wanting ice storage capacity, the production capacity is far too small. The known plant with chain drive at the bottom of the ice storage has, by one short wall of the storage, an ice-chipping device which chips off ice from an adjacent ice mass surface. The resulting chipped-off pieces of ice subsequently fall down to an underlying auger. Also this known plant is restricted to smaller sizes and capacities, about 10–20 tons of ice per day.

Besides the above-mentioned plants for producing, dividing and releasing ice, there are also manual ice storages, which constitute the system used most to date in connection with smaller plants. The ice is chopped into small pieces with a spade and are shovelled by hand into the rotating auger which transports the ice out of the ice storage. This manually operated plant assumes that the operator treads and walks on the ice chopped loose, and the use of such ice in connection with foodstuffs is not allowed.

A variant of said manually operated ice storage is the so-called "minor ice storage", in which loosened, comminuted ice is taken out through hatch openings at the side of the ice storage and into the utility crate. This variant of a plant is still in use and represents a small investment, but it is laborious and only suitable in connection with a minor ice storage capacity, a daily production of ice of about 10–15 tons.

SUMMARY OF THE INVENTION

The object of the present invention has therefore been to alleviate or reduce to a substantial degree, by simple and cheap means, the defects, drawbacks and limitations of application of known technique, and thus provide simple improving devices for ice storages, in which a novel and distinctive floor construction enables convenient outlet of ice from the bottom, whereby the ice first formed is the first to be discharged from the ice storage.

A special object aimed at through the invention, has been to attain an ice storage floor structure consisting of individual elements of multi-purpose function, which work, because of their shape, in particular their cross-sectional shape, in combination with the movement of the individual elements adjusted in pairs, as an ice-chipping and releasing means, and which together may form, in one preferred embodiment, when the ice within the storage is in its storage condition, a sufficiently tight ice storage floor, which is free from ice-leakage, and which constitutes the outlet opening of the ice storage in its active position.

The realization of the above object is implemented by the device according to the invention being formed and arranged so that it exhibits the characteristic features stated in the following claims.

The floor of an ice storage known in itself, where ice is produced and stored, for example in the form of cubes or as crushed plate-ice, is constituted according to the invention of elongate, parallel, rod-/pipe-shaped elements which are preferably all provided with distinct edge portions, which may be formed through the cross-sectional shape (cornered/polygonal cross-section) of the elements and/or through strip-shaped carriers extending in the longitudinal direction of the floor elements and distributed in the circumferential direction thereof.

The rod-/pipe-shaped ice storage floor elements are supported individually for rotation about their respective longitudinal axes. It is the rotational support of the floor elements that is effected individually; said elements may be driven by one common drive mechanism, for example a gear transmission, whereby each floor element has a gear arranged thereto, the gears being identical and engaging adjacent gears. Counted from one end of the ice storage floor, the outermost (left-hand) gear is arranged to rotate clockwise. Thereby the associated floor element is also rotated clockwise. The direction of rotation of the outermost but one gear is of course contrary and for the associated ice storage floor element also anti-clockwise.

The rotational directions of all gears and associated floor elements are given, and it should be evident that the gears and thereby the floor elements cooperate in pairs, two by two, rotating towards one another, and will thus have an outward/downward feeding effect on the ice, which has been chipped off above-lying ice mass by means of the cornered/polygonal (for example octagonal) distinct cross-sectional edge portions, possibly in combination with strip-like carrier means.

The same effect can be achieved if all floor elements have the same direction of rotation.

The elongate, straight, rod-/pipe-shaped ice storage floor elements may have such a diameter and be spaced so that, adapted to the transversal dimension of the strip-shaped carrier means, in a given rotational position of each floor element relative to the adjacent element(s), said elements will together form a tight ice storage floor. For rod/pipe elements that have a cornered/polygonal cross-section this applies when adjacent edge portions are brought into an approximately tightening abutment against one another, and by floor elements provided with carriers, when adjacent strip-shaped carrier means engage one another.

Instead of longitudinal, continuous carrier strips, in particular by floor elements of a cornered/polygonal cross-section, relatively narrowly spaced tooth-/spike-like chipping and carrying means may be used, for example arranged in groups in longitudinal and transversal rows or placed more randomly, distributed at random across the parallel rod-/pipe-shaped elements. Such carrier teeth or spikes may be formed and positioned so that by the individual rotational movements of the floor elements, they may be continuous, or the angle of rotation may be limited, for example to 180° in either direction, whereby every second rotational movement will constitute a return movement in relation to the feeding rotational movement. Such a rotation through a half rotation clockwise and then a half back turn, anti-clockwise, is the is easiest way of adapting the floor element to the desire for a tight ice storage floor in the idle ice-storing position thereof.

The external circumferential shape of the ice storage floor elements may vary, and for example, as mentioned, square pipes or pipes with an external polygonal circumferential shape, for example with an octagonal or hexagonal outer circumferential shape, may be used.

The floor elements, possibly with carriers, are sized and supported in the adjacent frame or wall structure, so that in its different conditions the ice storage floor can withstand the weight of the ice resting thereon.

The present invention entails substantial simplifications in the storing, detaching/chipping, releasing and transport of ice, and provides for a more hygienic storing, letting out and transport of ice from the ice storage to the place of consumption. This novel system is suitable for all types of ice, and there is no need for additional cooling, as with the known plants with augers at the bottom. The system according to the invention has few moving parts, which makes it very reliable in operation. By changing the rotational movement and/or speed of the individual floor elements, a desired adjustability may be achieved.

The ice which is produced in ice storages of the kind in question is normally shaped as cubes or is found in the form of crushed plate-ice. In the known plant with an auger at the bottom, where the ice storage is mostly used in connection with freezing flake-ice, cases of ice flakes melting and freezing to one another have been observed, and it is in order to avoid this that extra cold energy is supplied to the known plant. The ice storage of this known plant is placed in a cold storage, possibly equipped with a separate cooling device and insulated walls. This is a very elaborate and very expensive solution, and the present invention represents great simplifications relative to this, which will provide considerable financial savings.

A non-limiting example of preferred embodiments will be explained in the following with reference to the appended drawings, in which:

BRIEF DESCRIPTION OF THE DRAWINGS

FIG. 6 showing a second embodiment, in which the cross-sectional shape is circular for the outer circumference, provided with respective-eight longitudinal strip-shaped carriers equidistant spaced around the respective ice storage floor element;

FIG. 7 showing a third embodiment, in which the cross-sectional shape is regularly octagonal at the outer circumference; each floor element thus being formed with eight straight, distinct edges, which will work as efficient chipping means on the over-lying layer of ice, with no carriers;

FIG. 8 showing a fourth embodiment, in which the floor elements have a circle-cylindrical outer surface and are provided with two longitudinal, strip-shaped carriers; and FIG. 9 showing a fifth embodiment, in which the cross-sectional shape is regularly hexagonal, and in which the floor elements are each provided additionally with two longitudinal carrier strips.

DETAILED DESCRIPTION OF THE PREFERRED EMBODIMENTS

Figure 1:
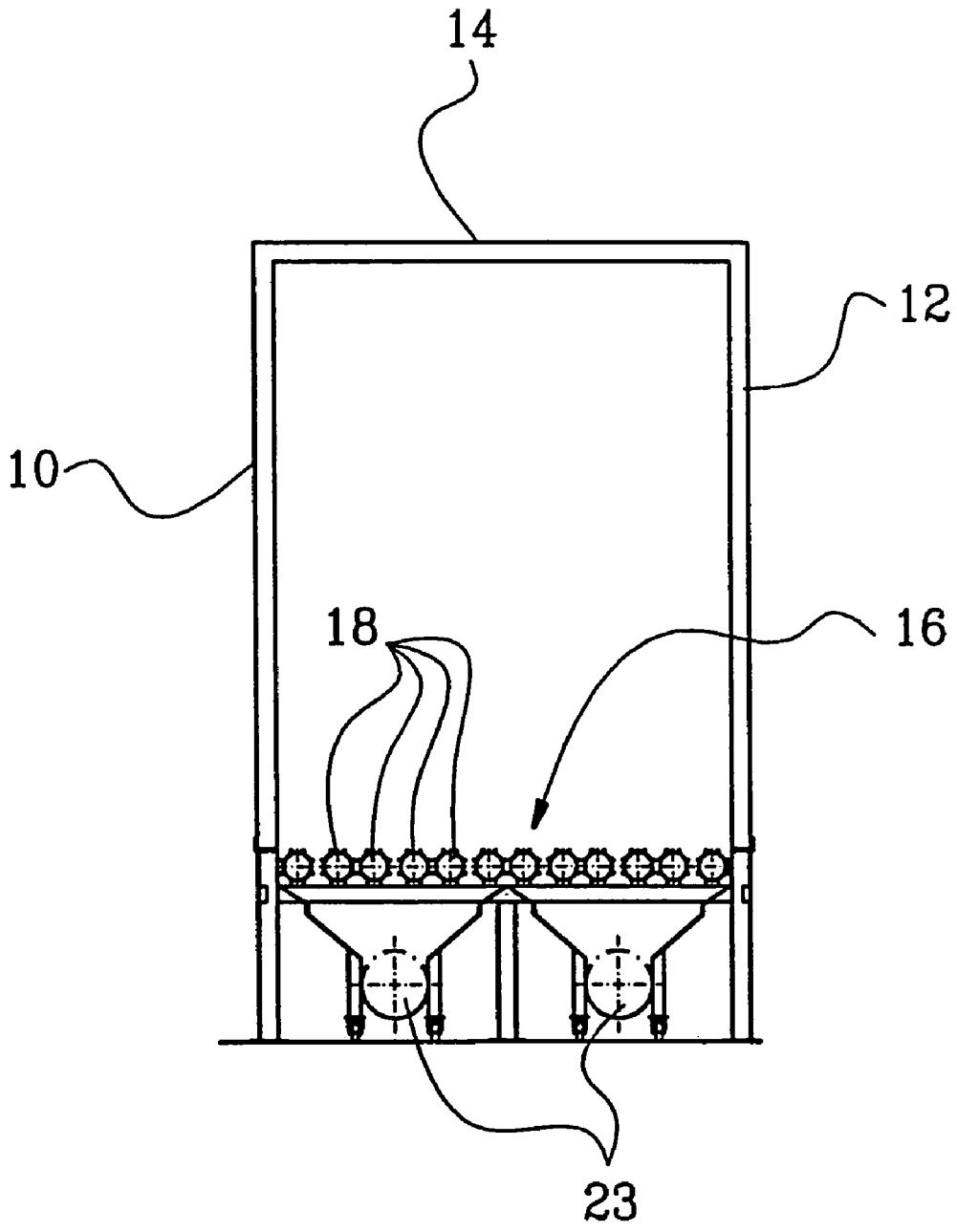
FIG. 1 shows a schematic end view of an ice storage with a floor formed and configured in accordance with the invention.
Figure 2:
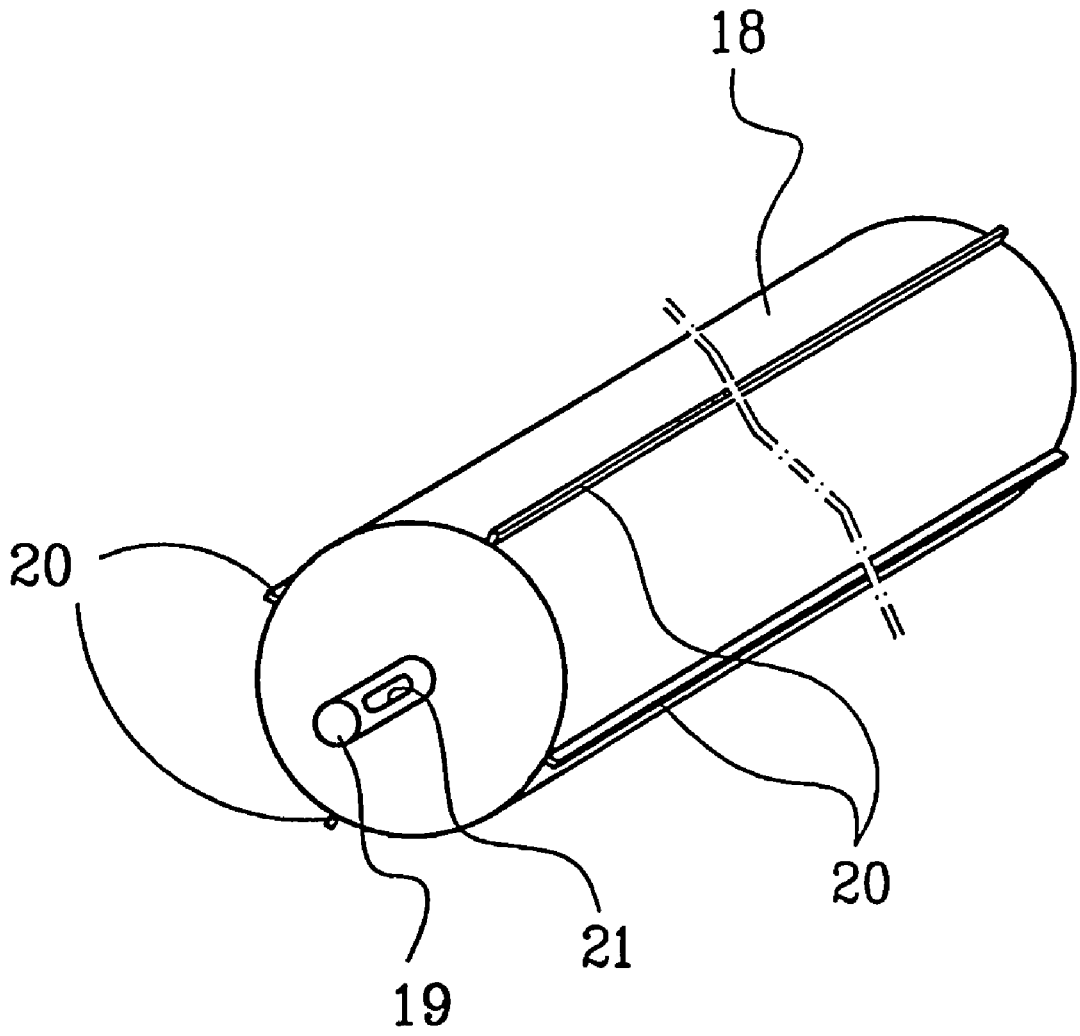
FIG. 2 shows, in a partial view, a longitudinal section of one pipe-shaped ice storage floor element with external carrier means in the form of longitudinal carrier strips, in 90° division.

Reference is first made to FIGS. 1 and 2, in which the reference numerals 10 and 12 in FIG. 1 identify opposite side walls of a schematically visualized ice storage, in which the ceiling wall is identified by 14 and the "floor" generally by 16.

Essentially, it is the floor structure 16 which forms the object of the present invention, it being formed of a suitable number, i.e. two or more, of elongate ice storage floor elements, generally identified by 18, extending parallel to one another in the longitudinal direction of the ice storage 10,12,14,16. The elongate elements or profiles are conveniently rod-like or tubular.

The ice storage floor 16 may have a horizontal extent or form a relatively small, acute angle with a horizontal plane.

Each individual tubular floor element 18 is rotationally supported individually, in a manner known in itself, dependent on surface area, cross-sectional profile, span, weight of the ice etc.

FIG. 2 shows a longitudinal floor element section which forms only part of the full length of the floor element. This floor element 18 is of tubular shape. An axle is identified by 19. The element 18 is externally provided with entirely or approximately radially projecting carrier means 20, which may extend, in this embodiment, throughout the length of the floor element 18. A key way in the end portion of the axle 19 is identified by 21.

In the embodiment shown in FIG. 2 of continuously extending carrier means, these may be placed, on adjacent floor elements 18, to engage one another in a sealing manner by partial rotation through an angle of 90°, for the formation is of an essentially tight ice storage floor 16. In case a leakage-free ice storage floor is not desirable or necessary for round floor elements 18, the consecutive carrier strips 20 may possibly be replaced by more tooth-/spike-like carriers (not shown) which will have—like the carrier strips 20—the intended chipping/scraping effect on the lowermost layer of the above-lying ice mass.

As explained earlier, the floor elements 18 rotate in pairs, two and two, in opposite directions of rotation, towards one another, in order to feed down ice mass, torn and loosened by the carriers 20, in the intermediate slots between the floor elements 18.

Figure 3:
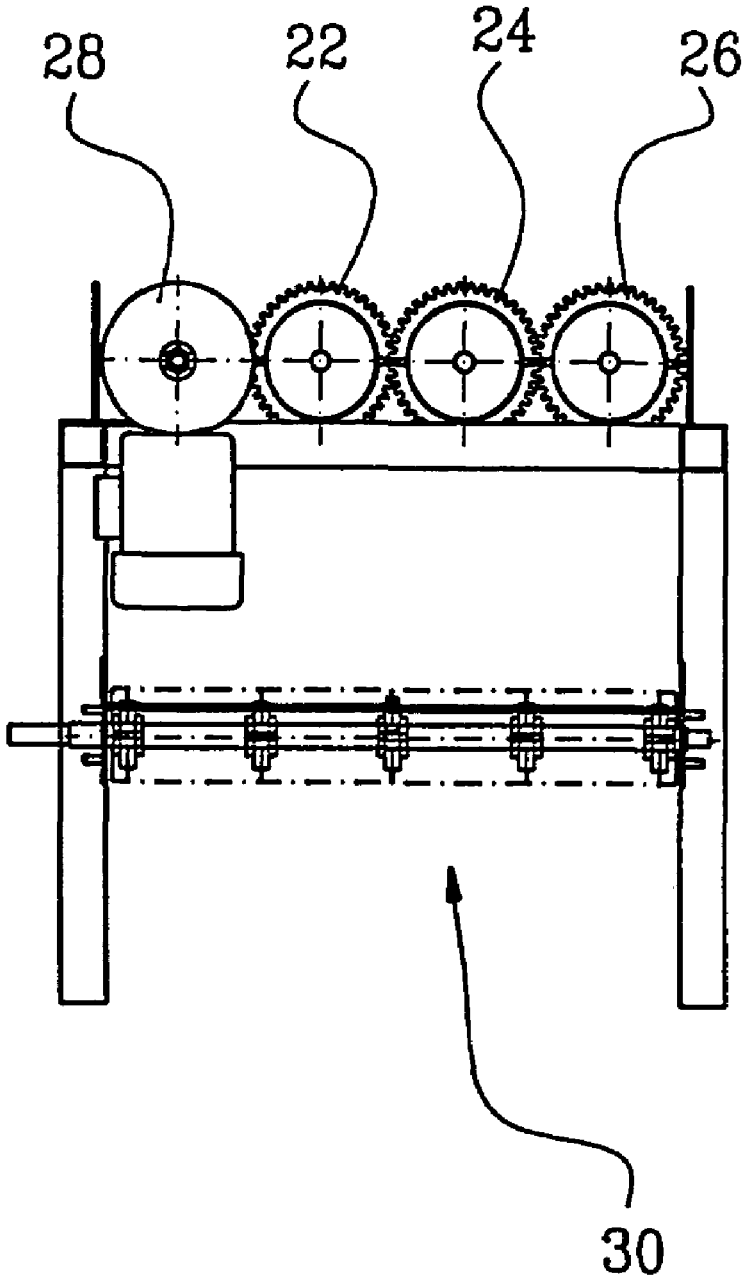
FIG. 3 shows an end view of a gear transmission comprising four mutually engaging, equally big gears, whose axes of rotation are on a common horizontal line, and where each gear is connected concentrically to an associated, rotationally supported floor element, so that in pairs the floor elements rotate, two by two, in opposite directions, towards one another, whereby a left-hand floor element (gear) of the pair rotates clockwise, whereas the other (right-hand) rotates anti-clockwise.
Figure 4:
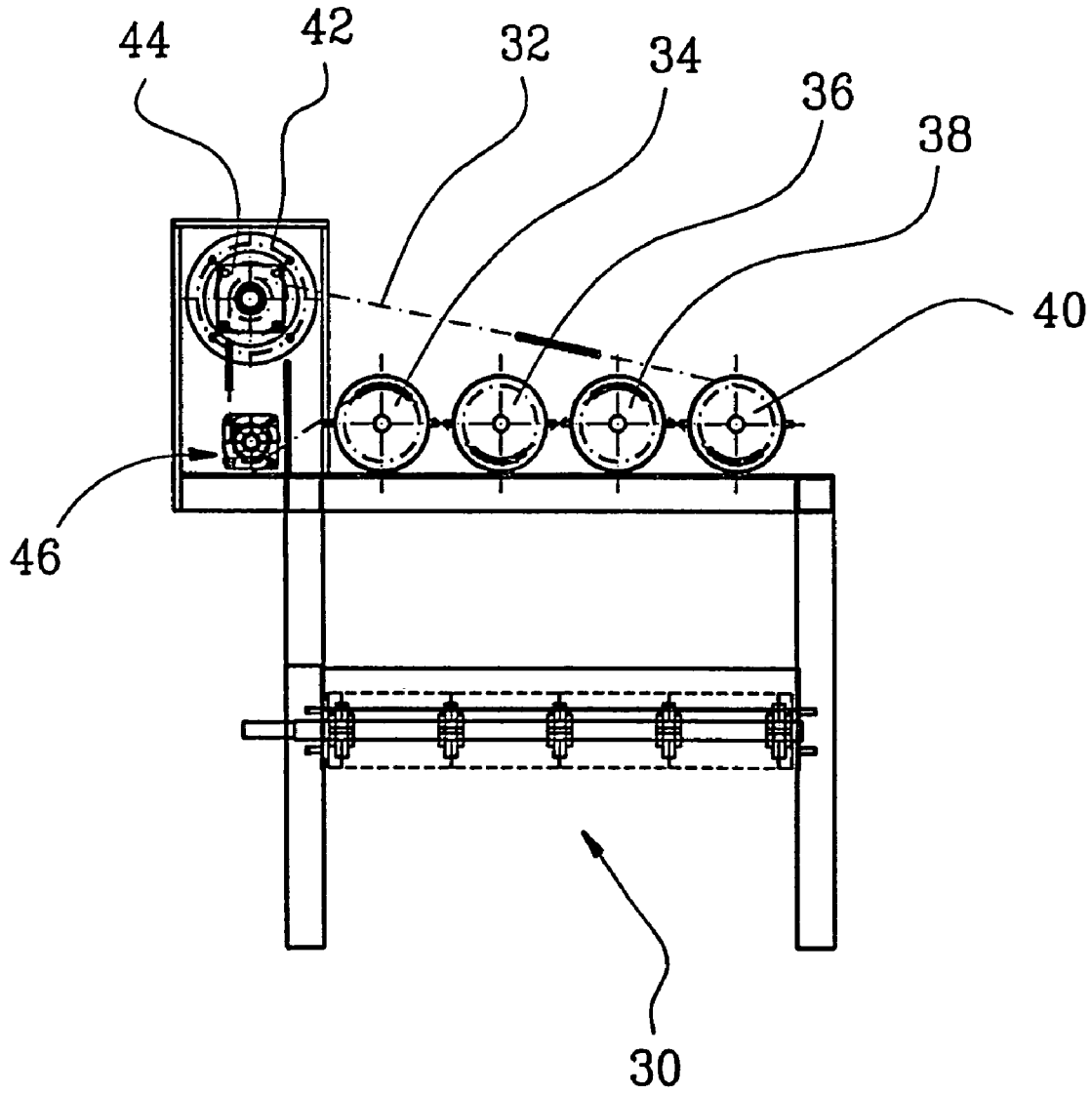
FIG. 4 corresponds to FIG. 3, but here is shown another embodiment of the drive mechanism of the floor elements, namely in the form of a chain drive.

This loosened mass, which falls down through the slots between the floor elements 18, lands at the bottom on a conveyor device in the form of, for example, one, two or more augers in upwards open, cylindrical housings 23, FIG. 1, or a conveyor belt 30, FIGS. 3 and 4. These conveyors and their positioning are not objects of the present invention.

It is arbitrary in what way the rotationally supported floor elements 18 are driven. In large plants, with very coarse profiles 18, a drive engine may be connected to each profile/pipe 18. However, it is often more convenient to use a gear transmission, chain or belt drive.

In FIG. 3 is suggested the use of a gear transmission on an ice storage floor (hidden behind the gears), in which each floor element has a concentric gear 22, 24, 26 arranged thereto (the gear on the left is hidden behind a drive engine 28), which are equally big and engage adjacent wheels. The hidden gear on the extreme left is assumed to be driven clockwise by the engine 28, so that the immediately following gear 22 is rotated anti-clockwise. The last two gears 24, 26 of this row of interconnected gears are rotated in the same manner, i.e. towards one another from the level of the axis downwards, to feed down chipped off mass of ice to an underlying conveyor belt 30.

To achieve the same pattern of rotation as in FIG. 3, by the belt or chain drive 30 in FIG. 4, the belt/chain is run in a "sinusoidal" path, so that the chain wheels 34 and 36 and associated floor elements 18 on the one side, and the chain wheels 38 and 40 and associated floor elements 18 on the other side are brought to rotate towards one another through opposite directions of rotation, from the axis level downwards, in order to feed down chipped off ice mass to an underlying conveyor belt 30.

An engine 42 with a small driving chain wheel 44 wedged to the output driving shaft thereof, is mounted on a frame portion somewhat above the chain wheels 34, 36, 38 and 40. The chain 32 is laid over this drive wheel 44 and from there on about a tightening wheel 46 which also serves to guide the chain 32 in towards the upper circumferential portion of the chain wheel 34. Thereby, the chain 32 gets to attack a larger arc of the chain wheel 34 than if the chain 32 was passed directly from the drive wheel 44 to the upper circumferential portion of the chain wheel 34.

The profiled floor elements 18 may be supported/driven for continuous rotation in one and same direction, towards each other in pairs in opposite directions, or the support/driving method may be based on pitched rotation (preferably 180° in opposite directions, down and then back up into start position) of each floor element.

By adjustment of the speed of rotation of the floor elements 18, the ice discharging rate could be adjusted as required.

Figure 5:
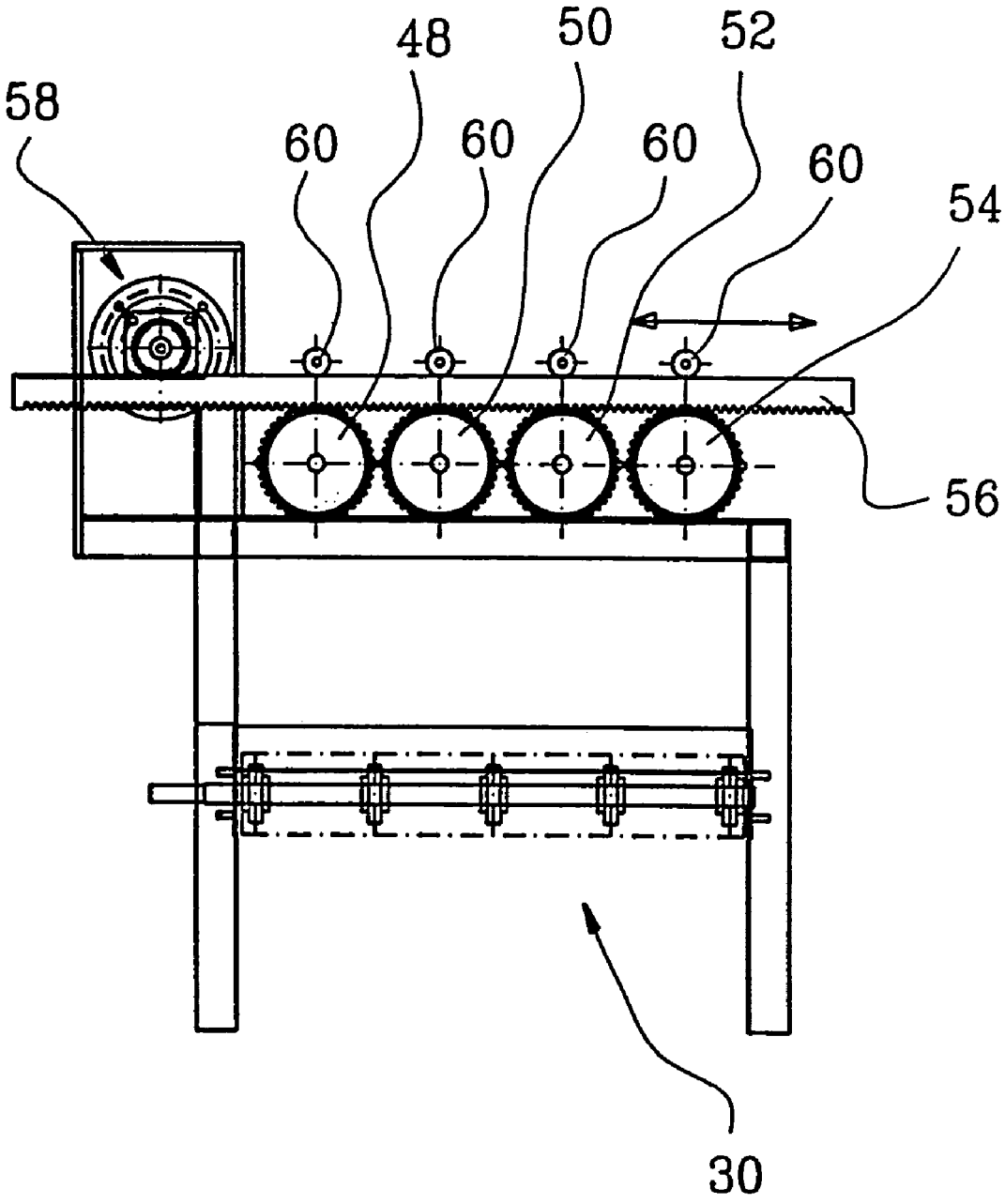
FIG. 5 corresponds to FIGS. 3 and 4, but here is shown a third embodiment of the drive mechanism of the floor elements, namely relative to gears driven by a common motorized pitch rack.

According to FIG. 5, each of, for example, four parallel horizontally extending ice storage floor elements (not visible) is provided with a transmissions means in the form of a cylindrical gear 48, 50, 52 and 54 engaged and driven by a shared motorized pitch rod 56. Above-lying, parallel, horizontally extending, freely rotational support and guide rollers 60 retain the displaceable pitch rod 56 in a driving engagement with each of the gears 48, 50, 52, 54. By the reference numeral 58 is generally identified a drive engine, on whose output shaft is wedged a gear with small teeth that engage corresponding teeth spaces on a toothed portion of the pitch rod 56.

Figure 6:
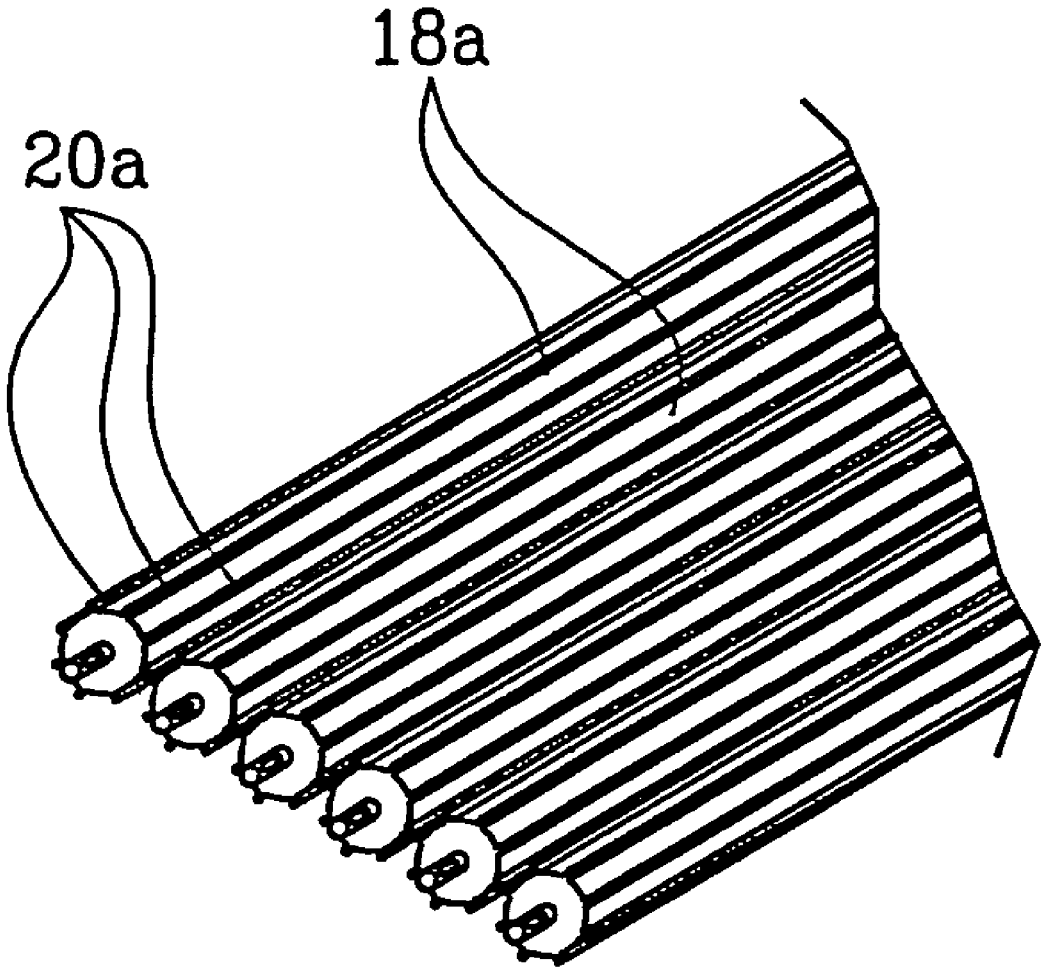
FIGS. 6–9 show alternative embodiments of the floor elements of the ice storage, where.

FIGS. 6–9 show some different cross-sectional shapes (with and without carrier/chipping strips 20) for ice storage floor elements, in which;

FIG. 6 shows a circular cross-section with eight carrier/chipping strips 20*a* (central angle 45°). This second type of element is identified by 18*a*.

Figure 7:
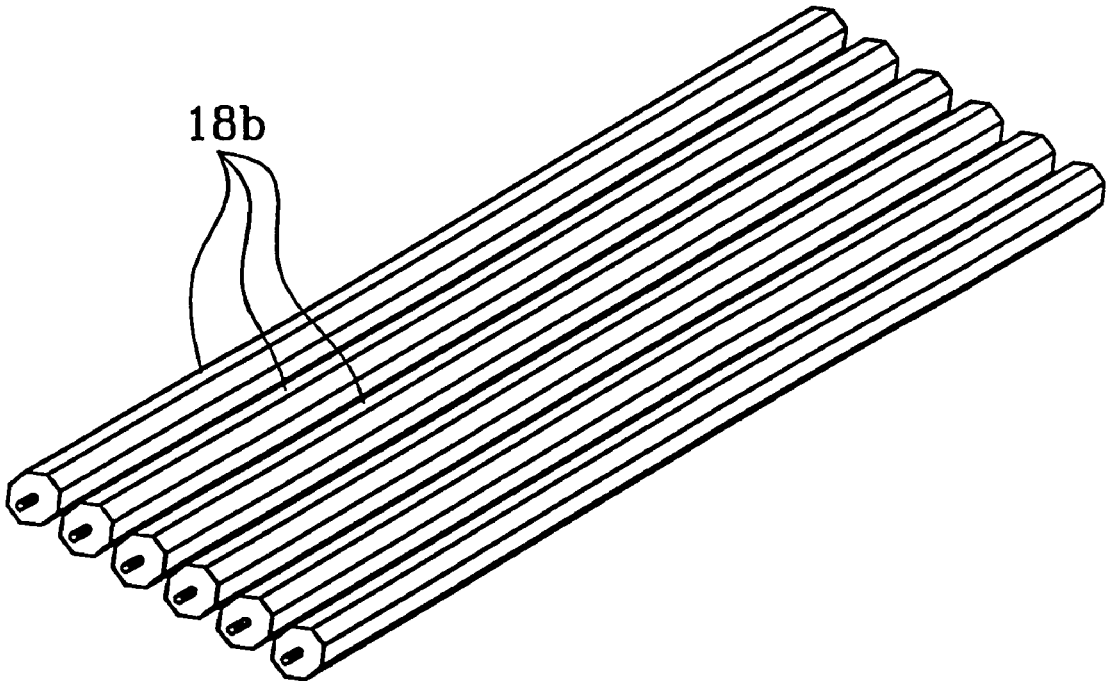

In FIG. 7 the cross-sectional shape of the floor elements 18*b* is regularly octagonal, and here no carrier strips are used. The octagonal cross-section provides distinct, longitudinal edge portions of excellent chipping and carrying properties.

Figure 8:
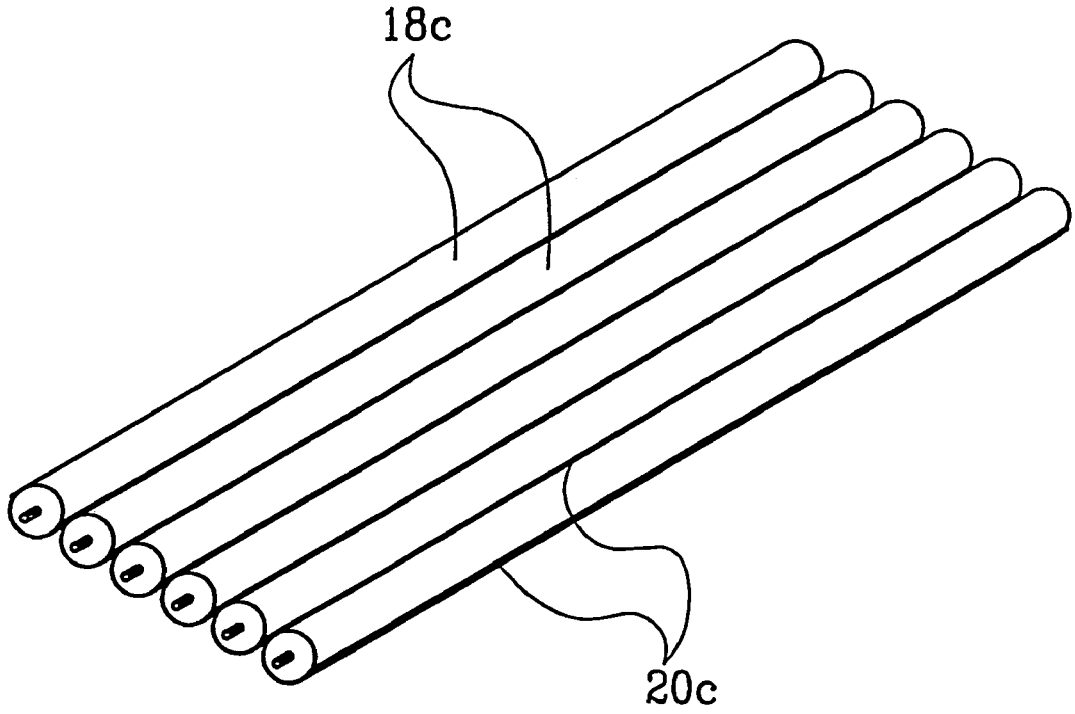

According to FIG. 8 the cross-sectional shape is circular, and each floor element 18*c* is provided with two carriers 20*c*.

Figure 9:
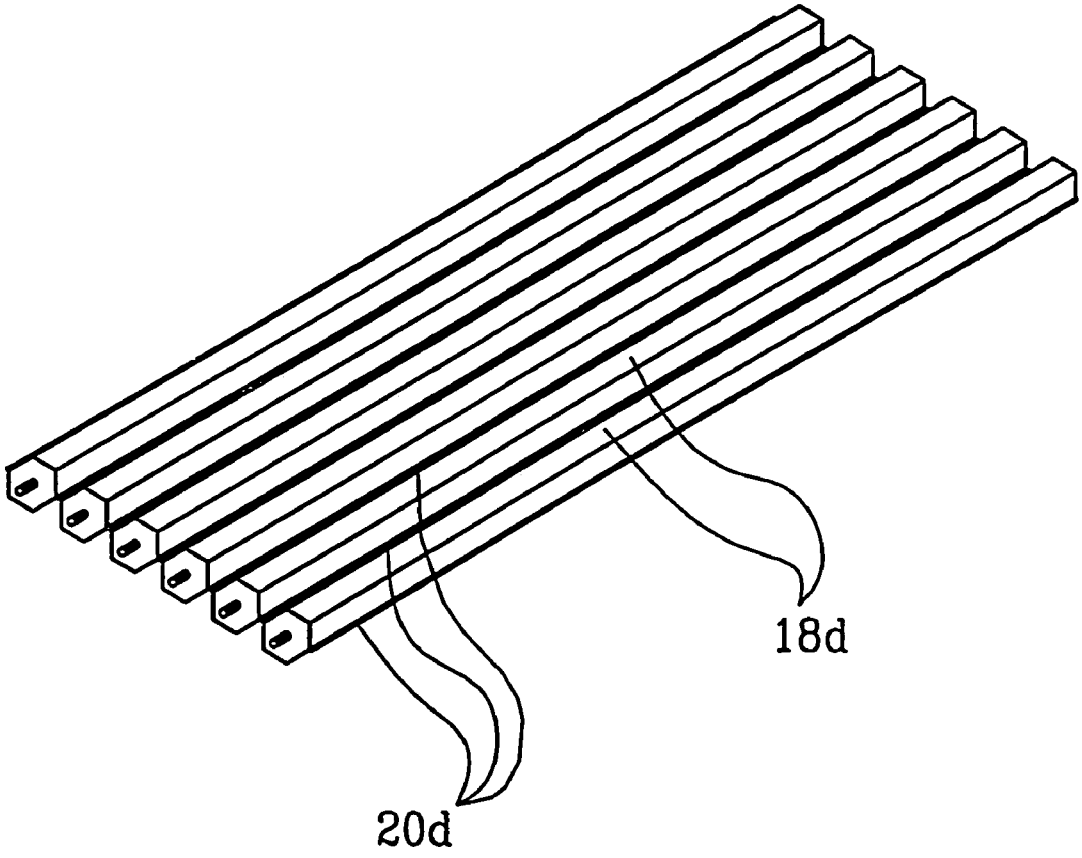

In FIG. 9 the cross-sectional shape is hexagonal, which provides, as far as it goes, the desired distinct longitudinal edge portions of chipping and carrying properties by the rotational motions of the floor elements 18*d*. However, in this embodiment of the floor elements it has been preferred to fit two carrier strips 28*d*.

The invention claimed is:

1. An ice storage or other ice-producing/storing room device with side walls (10, 12) and a floor construction (16), and at least one underlying conveyor (23; 30) to carry away ice, which has been chipped loose and thus been separated from the ice mass in the ice storage, characterized in that said floor construction (16) consists of elongate, essentially mutually parallel, floor elements (18; 18*a*; 18*b*; 18*c*; 18*d*) with intermediate slots, the floor elements being rotational and arranged to be driven individually, in pairs or collectively, and that at least one floor element is formed with distinct edge portions formed by a cornered/polygonal cross-sectional shape of the at least one floor element and/or its external carrier elements (20; 20*a*; 20*c*; 20*d*).

2. A device according to claim 1, characterized in that the floor elements (18; 18*a*; 18*b*; 18*c*; 18*d*) are freely rotational, in both directions of rotation, and have a drive mechanism (28; 42; 58) arranged thereto, which ensures, by interconnection of a transmission device (22, 24, 26; 32, 34, 36, 38, 40), a rotation of the floor elements (18) in pairs in opposite directions, towards one another.

3. A device according to claim 2, characterized in that each rotationally supported floor element is fitted with a pulley or a chain wheel (34, 36, 38, 40), a driven, endless belt or chain (32) being positioned alternately over an upper circumferential portion of a first pulley/chain wheel, and over a lower circumferential portion of an adjacent second pulley/chain wheel.

4. A device according to claim 2, characterized in that each rotationally supported floor element (18) is fitted with gears (22, 24, 26) engaging one another.

5. A device according to claim 2, characterized in that each rotationally supported floor element (18) is fitted with a gear (48, 50, 52, 54) which is engaged and driven by a shared motorized pitch rod (56).

6. A device according to claim 1, characterized in that the carrier elements (20; 20*a*; 20*b*; 20*c*; 20*d*) have the form of elongate carrier strips, which extend essentially in a longitudinal direction of the floor elements (18), coextensively with the floor elements.

7. A device according to claim 6, characterized in that the floor elements (18; 18*a*; 18*b*; 18*c*; 18*d*) are spaced apart laterally to form an intermediate slot or slots, and that the carrier strips (20; 20*a*; 20*b*; 20*c*; 20*d*) have a radial extent beyond the outer surfaces of the floor elements, somewhat shorter than a width of the slot, and that the carrier strips of one floor element (18; 18*a*; 18*b*; 18*c*; 18*d*) are placed so in relation to the carrier strips (20; 20*a*; 20*b*; 20*c*; 20*d*) of at least one adjacent floor element that the carrier strips engage one another by rotational motions of the two floor elements.

8. A device according to claim 1, characterized in that the carrier elements have the form of teeth or spikes.

9. A device according to claim 1, characterized in that each floor element has a limited rotatability of about 180° in both directions of rotation.

10. A device according to claim 1, characterized in that each of the ice storage floor elements (18*b*) has a regularly octagonal cross-section.

11. A device according to claim 1, characterized in that each of the ice storage floor elements (18*d*) has a regularly hexagonal cross-section and is equipped with carrier strip elements (20*d*).

12. A device according to claim 1, characterized in that each floor element (18; 18*a*; 18*c*) has a circular cross-section and is provided with two, four or eight carrier strips (20; 20*a*; 20*c*) equidistantly spaced around a circumference of the respective floor element.

* * * * *

UNITED STATES PATENT AND TRADEMARK OFFICE

CERTIFICATE OF CORRECTION

PATENT NO. : 7,137,582 B1
APPLICATION NO. : 09/959789
DATED : November 21, 2006
INVENTOR(S) : Mikkelsen et al.

It is certified that error appears in the above-identified patent and that said Letters Patent is hereby corrected as shown below:

Title page (*) Notice: Delete “0 days” and insert --632 days--.

Signed and Sealed this

Fourth Day of March, 2008

JON W. DUDAS
*Director of the United States Patent and Trademark Office*